US009878370B2

(12) United States Patent
An et al.

(10) Patent No.: US 9,878,370 B2
(45) Date of Patent: Jan. 30, 2018

(54) BIMODAL METAL MATRIX NANOCOMPOSITES AND METHODS OF MAKING

(71) Applicant: University of Central Florida Research Foundation, Inc., Orlando, FL (US)

(72) Inventors: Linan An, Oviedo, FL (US); Jinling Liu, Xi'an Shaanxi (CN)

(73) Assignee: University of Central Florida Research Foundation, Inc., Orlando, FL (US)

( * ) Notice: Subject to any disclaimer, the term of this patent is extended or adjusted under 35 U.S.C. 154(b) by 555 days.

(21) Appl. No.: 14/156,935

(22) Filed: Jan. 16, 2014

(65) Prior Publication Data

US 2016/0101468 A1 Apr. 14, 2016

Related U.S. Application Data

(60) Provisional application No. 61/753,116, filed on Jan. 16, 2013.

(51) Int. Cl.

| | |
|---|---|
| ***B22F 3/10*** | (2006.01) |
| ***C22C 32/00*** | (2006.01) |
| ***B22F 1/00*** | (2006.01) |
| ***B22F 9/04*** | (2006.01) |

(52) U.S. Cl.

CPC ..... *B22F 3/10* (2013.01); *B22F 1/0055* (2013.01); *B22F 1/0062* (2013.01); *B22F 9/04* (2013.01); *C22C 32/00* (2013.01); *C22C 32/0063* (2013.01); *B22F 2009/043* (2013.01); *B22F 2201/11* (2013.01); *B22F 2201/20* (2013.01); *B22F 2301/058* (2013.01); *B22F 2302/105* (2013.01); *B22F 2304/10* (2013.01); *B22F 2998/10* (2013.01); *B22F 2999/00* (2013.01)

(58) Field of Classification Search

CPC ..... B22F 9/04; B22F 3/10; B22F 1/0055
USPC ..... 419/23
See application file for complete search history.

(56) References Cited

U.S. PATENT DOCUMENTS

2007/0264149 A1* 11/2007 Martinez Sanchez .. C22C 21/00 419/5

OTHER PUBLICATIONS

Ferkel et al. (Materials Science and Engineering A298 (2001) 193-199).*

Ye, Jinchun, et al.; A Tri-Modal Aluminum Based Composite with Super High Strength; Department of Material Science, University of Southern California; Jun. 2, 2005; pp. 481-486.

(Continued)

*Primary Examiner* — Weiping Zhu
(74) *Attorney, Agent, or Firm* — Dunlap Codding, P.C.

(57) ABSTRACT

A bimodal metal nanocomposite of ceramic nanoparticles in a metal or metal alloy matrix has a microstructure showing a first "hard" phase containing the ceramic nanoparticles in the metal or metal alloy matrix, and a second "soft" phase comprising only the metal or metal alloy with few or no ceramic nanoparticles. The stiffness and yield strength of the bimodal metal nanocomposite is significantly increased compared to the metal or metal alloy alone, while the ductility of the metal or metal alloy is retained. A process for making the bimodal metal matrix nanocomposite includes milling a powder mixture of micrometer-size metal flakes and ceramic nanoparticles for a time sufficient to embed the ceramic nanoparticles into the metal flakes.

24 Claims, 2 Drawing Sheets

(56) References Cited

OTHER PUBLICATIONS

Hassan, S.F. , et al.; Development of High Performance Magnesium Nano-Composites Using Nano-$A1_2O_3$ as Reinforcement; Department of Mechanical Engineering, National University of Singapore; Sep. 23, 2004; pp. 163-168.

Montoya-Dávila, M., et al.; Effect of Bi- and Trimodal Size Distribution on the Superficial Hardness of $A1/SiC_p$ Composites Prepared by Pressureless Infiltration; Cinvestav Mérida. Km.; Feb. 23, 2007; pp. 66-71.

Asadi, P., et al.; Experimental Investigation of Magnesium-Base Nanocomposite Produced by Friction Stir Processing: Effects of Particle Types and Number of Friction Stir Processing Passes; Metallurgical and Materials Transactions; Sep. 2011; vol. 42A; pp. 2820-2832.

Tang, Feng, et al.; Formation of Coarse-Grained Inter-Particle Regions During Hot Isostatic Pressing of Nanocrystalline Powder; Department of Chemical Engineerinf and Materials Science; Jun. 21, 2005; pp. 619-624.

Ferkel, H., et al.; Magnesium Strengthened by SiC Nanoparticles; Institut für Werkstofkunde und Wedstofftechnik; Jun. 15, 2000; pp. 193-199.

Lan, Jie, et al.; Microstructure and Microhardness of SiC Nanoparticles Reinforced Magnesium Composites Fabricated by Ultrasonic Method; Materials Science Program University of Wisconsin-Madison; Jun. 7, 2004; pp. 284-290.

* cited by examiner

BIMODAL METAL MATRIX NANOCOMPOSITES AND METHODS OF MAKING

CROSS REFERENCE TO RELATED APPLICATIONS/INCORPORATION BY REFERENCE STATEMENT

The entirety of U.S. provisional application Ser. No. 61/753,116 filed on Jan. 16, 2013, is hereby expressly incorporated herein by reference.

BACKGROUND OF THE INVENTIVE CONCEPTS

1. Field of the Inventive Concepts

The presently claimed and disclosed inventive concepts relate generally to metal matrix composites, and more particularly, to metal matrix nanocomposites having a bimodal microstructure and to methods of making bimodal metal matrix nanocomposites.

2. Brief Description of Related Art

Particle reinforced metal matrix composites (MMCs) have gained extensive attention for structural applications because of their high specific strength and elastic modulus, near-isotropic properties, and excellent high-temperature creep resistance. In particular, magnesium-based metal matrix composites (MMMCs) have attracted increasing interest due to the fact that magnesium is the lightest metallic material. However, the significantly reduced ductility of micrometer-sized particle reinforced MMMCs has limited their application.

Consequently, magnesium-based metal matrix nanocomposites (MMMNCs) have been developed, with the assumption that the mechanical properties of MMCs could be further enhanced while retaining ductility by using nano-sized reinforcements. Powder metallurgy, disintegrated melt deposition (DMD), ultrasonic cavitation based casting, and friction stir processing have been utilized to manufacture MMMNCs which show a high degree dispersion and uniformity of the reinforcement. It has been demonstrated that these processes can produce magnesium nanocomposites containing less than 1 volume percentage ceramic nanoparticles which exhibit good mechanical properties while retaining ductility. However, these processes are complex and costly, and the mechanical properties of the magnesium nanocomposites containing less than 1 volume percent of ceramic nanoparticles are still not good enough for many applications.

It would be advantageous to develop metal matrix nanocomposites and MMMNCs having improved mechanical properties while retaining ductility. It would also be advantageous if a low cost process could be developed to produce metal matrix nanocomposites including MMMNCs containing a high volume fraction of nano-sized ceramic particles.

SUMMARY OF THE DISCLOSURE

A bimodal metal nanocomposite has ceramic nanoparticles in a metal or metal alloy matrix. The microstructure of the bimodal metal nanocomposite shows a first and second phase; the first "hard" phase contains the ceramic nanoparticles in the metal or metal alloy matrix, while the second "soft" phase comprises only the metal or metal alloy with few or no ceramic nanoparticles. The stiffness and yield strength of the bimodal metal nanocomposite is significantly increased compared to the metal or metal alloy alone, while the ductility of the metal or metal alloy is retained.

A process for making a bimodal metal matrix nanocomposite includes milling a powder mixture comprising micrometer-size metal flakes and ceramic nanoparticles for a time sufficient to embed a majority of the ceramic nanoparticles into the metal flakes. In one embodiment, the milled metal flakes with embedded ceramic nanoparticles are sintered at conditions to produce a nanocomposite having the above-described bimodal microstructure.

DETAILED DESCRIPTION

Figure 1:
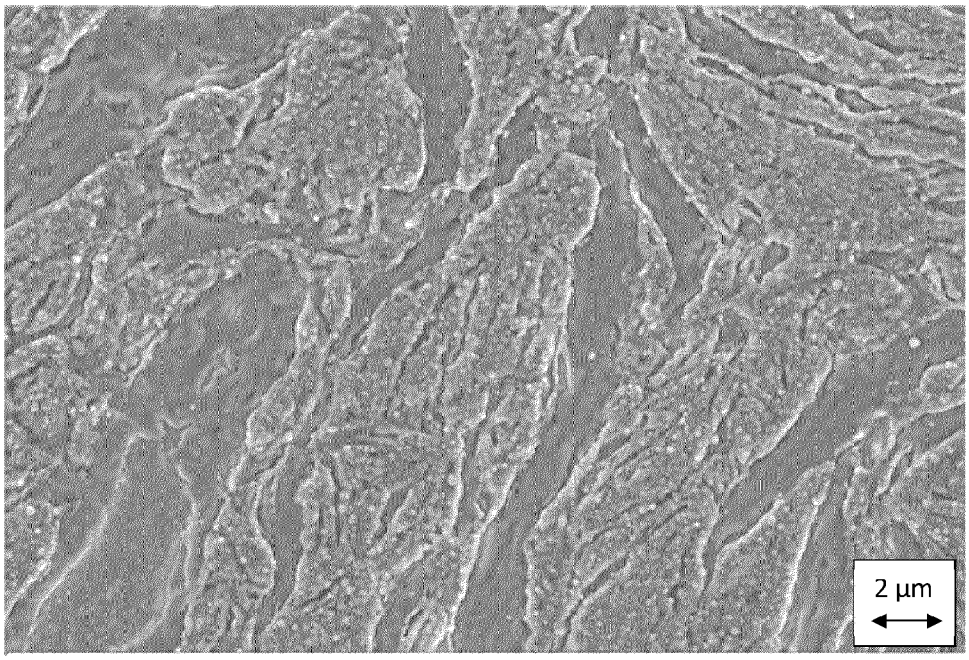
FIG. 1 shows the bi-model microstructure of a Mg matrix nanocomposite made in accordance with the inventive concepts disclosed herein.

Before explaining at least one embodiment of the inventive concepts disclosed herein in detail, it is to be understood that the inventive concepts are not limited in their application to the details of construction, experiments, exemplary data, and/or the arrangement of the components set forth in the following description, or illustrated in the drawings. The presently disclosed and claimed inventive concepts are capable of other embodiments or of being practiced or carried out in various ways. Also, it is to be understood that the phraseology and terminology employed herein is for purpose of description only and should not be regarded as limiting in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

The term "bimodal microstructure" is used herein and in the appended claims to describe a material having a microstructure with two distinguishable types of areas or volumes (phases) with different ceramic nanoparticle concentrations. The term "hard phase" is used herein to refer to the microstructure phase having high volume fraction of nano-size ceramic particles. The term "soft phase" is used herein to refer to a microstructure phase having few or no nano-size ceramic particles.

The term "nanoparticles" is used herein and in the appended claims to mean particles having an average diameter less than 100 nanometers.

The term "metal" herein and in the appended claims includes metal alloys, and the term "metal flakes" is meant to include metal alloy flakes.

Finally, as used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

It was discovered that a bimodal metal matrix nanocomposite containing nano-sized ceramic particles could be produced by a combination of ball-milling micrometer-sized flakes of metal or metal alloy with the ceramic nanoparticles for a time sufficient to embed the ceramic nanoparticles into the surfaces of the metal or metal alloy flakes. Upon sintering, the resulting bimodal metal nanocomposites show a microstructure having a first and second phase. The first "hard" phase contains the ceramic nanoparticles in the metal or metal alloy matrix, while the second "soft" phase comprises the metal or alloy with few or no ceramic nanoparticles. The stiffness and yield strength of the bimodal metal nanocomposites are significantly increased compared to the metal or metal alloy alone, while the ductility of the metal or metal alloy is retained.

Suitable metals or metal alloys include, but are not limited to magnesium, aluminum, copper, iron, tin, titanium and nickel metal or alloy. In one embodiment, magnesium metal and/or magnesium metal alloy with flake morphology is used. Micrometer-sized metal flake is available commercially and is used, for example, in flash powder formulations containing flake aluminum or magnesium powder.

In one embodiment, the metal or metal alloy flakes have a mean particle size of from about 1 to about 250 micrometers. In another embodiment, the metal or metal alloy flakes have a mean particle size of from about 50 to about 200 micrometers. As used herein, the mean particle size of flake-shaped particles (flakes) refers to the average median diameter of the flakes laying on a flat surface, which does not typically reflect the thickness of the flake. This is consistent with commercial sizing of micrometer-size particles which are commonly sized by mesh, such that an average "particle size" or "particle diameter" reflects the size retained or passing a given sieve size.

The ceramic nanoparticles can be of any suitable ceramic including, but not limited to silicon carbide, silicon nitride, aluminum oxide, boron carbide, titanium nitride, titanium oxide, zirconium oxide, yttrium oxide, and cerium oxide. The ceramic nanoparticles are harder than the metal or metal alloy used for the composite matrix. In one embodiment, the ceramic nanoparticles comprise silicon carbide.

The ceramic nanoparticles can have a mean particle size ranging from 1 nm to 100 nm. In one embodiment the ceramic nanoparticles have an average particle size of from about 20 nm to about 100 nm. As used herein, the mean particle size refers to the average particle diameter.

The volume percent of ceramic nanoparticles mixed with the micrometer-size metal flakes can vary widely. The powder particles can be mixed prior to milling using mixing equipment known to those skilled in the art. Alternatively, the particles can be added separately to the mill relying on the milling process to provide the necessary mixing.

The nanoparticles are added in sufficient quantity to obtain the strength and hardness desired of the resulting metal matrix nanocomposite. Historically, addition of ceramic nanoparticles to metal or metal alloy powders resulted in a brittle nanocomposite. However, it has been discovered that milling of flake metal or metal alloy particles with ceramic nanoparticles can produce a nanocomposite that is not brittle. While not intending to be limited by any particular mechanism, it is believed that embedding the nanoparticles into surfaces of the metal flakes, causes these surface areas to have high ceramic concentrations resulting in a "hard" phase of the microstructure. The interior of the flakes have few or no ceramic nanoparticles and provide the "soft" phase in the microstructure, thereby retaining the ductility.

In one embodiment, the powder mixture milled contains greater than 5 vol % ceramic nanoparticles based on the total powder mixture volume. In another embodiment, the powder mixture contains up to 20 vol % ceramic nanoparticles. In yet another embodiment, the powder mixture contains between 5 vol % and 20 vol % ceramic nanoparticles.

A surfactant or grinding aid can be added to the powder mixture to prevent cold welds between metal particles during milling. Both steric acid and ethanol were effective to prevent such welding; however, numerous surfactants and grinding aids can be used. In one embodiment, between 1 wt % and 5 wt % surfactant or grinding aid is added to the powder mixture before or during milling.

Suitable milling equipment for very fine particles is known to those skilled in the art. In one embodiment, a planetary miller is used. Planetary ball mills are smaller than common ball mills and are most often used in laboratories. In a laboratory planetary mill, a grinding jar is arranged eccentrically on a "sun wheel" wherein the direction of movement of the sun wheel is opposite to that of the grinding jar, giving varied and controllable grinding effects.

To avoid oxidation of the fine metal particles, the powder mixtures can be handled and milled in an inert atmosphere. In one embodiment, the powder mixture is handled and milled in an atmosphere of argon.

Ceramic balls are used in the milling step. In one embodiment, the ceramic balls have a density less than the density of the ceramic nanoparticles. Zirconia balls are used in one embodiment. The ratio of the weight of the ceramic balls to the weight of the powder mixture is around 10:1, but can vary from about 5:1 to about 20:1.

The milling step can be conducted at room temperature with a batch milling time of about 10-20 hours. The powder mixtures are milled for a controlled period to embed the ceramic nanoparticles into the flake metal powders. In one embodiment, the milling time is set to embed at least 95% of the ceramic nanoparticles in the metal or metal alloy particles. Milling speeds depend in part on the size of the mill; however, laboratory milling speed of 150 rpm to 200 rpm were found to be satisfactory.

During grinding the mill may heat. Depending on the powder mixture composition, it may be desirable to cool the mill and open it in an inert atmosphere. After grinding, additional surfactant can be added to the powder mixture to aid in removal and recovery of the metal or metal alloy flakes with embedded ceramic nanoparticles.

The milled metal or metal alloy flakes with embedded ceramic nanoparticles can be sintered to form a dense, bulk nanocomposite wherein the microstructure is bimodal. Sintering equipment, furnaces and procedures are known to those skilled in the art. In one embodiment, the flakes are heated to about 0.9 $T_m$ (melting temperature of the matrix) in a vacuum under a compressive load (vacuum hot press sintering). Sintering to greater than 98% of theoretical density can be achieved while retaining the bimodal nature of the metal matrix nanocomposite and the unique properties of high strength and retained ductility.

The resulting process is based on simple and traditional powder metallurgy processing, and offers significant advantages, such as short processing time, simple equipment, and high performance.

In order to further illustrate the present invention, the following examples are given. However, it is to be understood that the examples are for illustrative purposes only and are not to be construed as limiting the scope of the invention.

EXAMPLES

A magnesium matrix nanocomposite was fabricated using magnesium powder of analytical reagent grade phase-purity and a mesh size of −100 and 50 nm β-Sic powder were used. The mixed powders containing 5 vol %, 10 vol % and 15 vol % 50 nm β-SiC were mixed under argon atmosphere inside a glove box to minimize any contamination resulting from handling of powders in the atmospheric air. The powder mixture was then milled in a planetary miller at 180 rev/min and room temperature using a stainless steel grinding vial and zirconia balls of 10 mm size. About 1-3 wt % of stearic acid of analytical reagent grade was added into the vial as the process control agent for the first 20 hours; then about 1-2 wt % of stearic acid was added into the vial for the next 10 hours to gain fine powders. The ratio of the weight of zirconia balls to the total powder was approximately 10:1. The powders and the balls were loaded into the vials inside an argon-filled glove box. The milled powders were heated using a vacuum-hot-press furnace. A cylindrical graphite die of filled with milled powder was set in the equipment, and heated in a vacuum (10 Pa or lower) with a compressive load of 50 MPa. The powders were heated to 575° C. at a heating rate 100° C./min and held for for 5 min. This was followed by cooling at cooling rate 60° C./min and removal of the compressive load.

Figure 2:
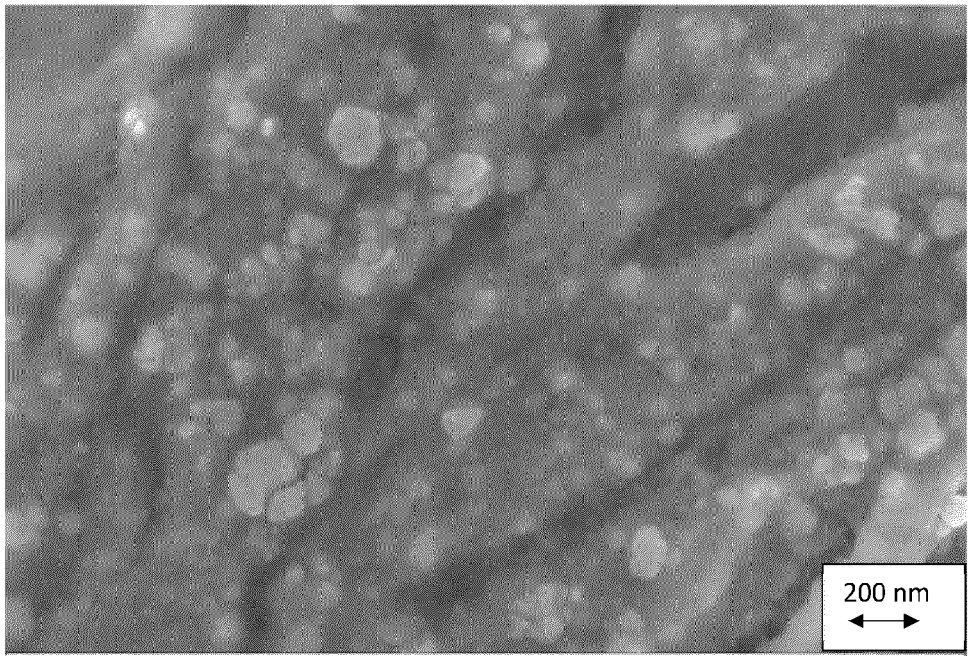
FIG. 2 shows the uniform distribution of nanoparticles within the "hard" phase of a Mg matrix nanocomposite made in accordance with the inventive concepts disclosed herein.

The microstructure of the magnesium matrix nanocomposite containing 5 vol % SiC particles is shown in FIG. 1. The material contains two phases: one is a hard phase, the other is a soft phase. Both of the phases present flake structure in the material. Most of the soft phase is isolated by hard phase, and the uniform distribution of the soft phase in the hard phase is shown in FIG. 1. The uniform distribution of the nanoparticles in Mg matrix within the hard phase is shown in FIG. 2.

Figure 3:
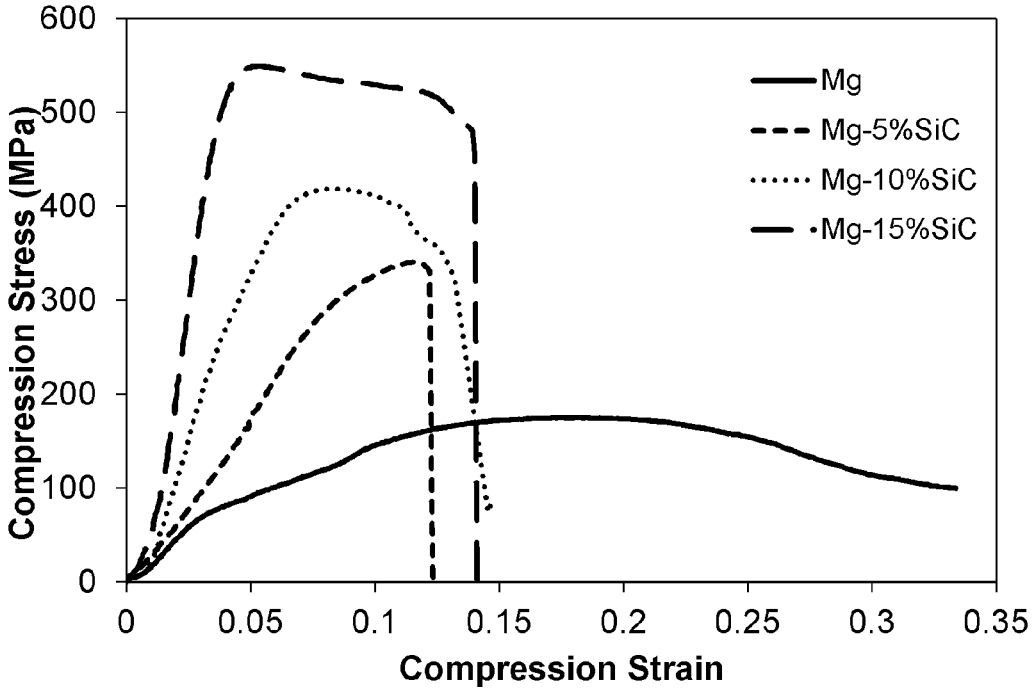
FIG. 3 shows compressive stress-strain curves of pure magnesium metal compared to a bimodal Mg matrix nanocomposites produced in accordance with the inventive concepts disclosed herein.

The compressive stress-strain curve was depicted in FIG. 3. The nanocomposites exhibited higher stiffness and yield strength with retained ductility. The yield strength of Mg-5 vol % SiC nanocomposite approach 290 MPa. It is twice as strong as the pure Mg. Particularly, the yield strength of Mg-15 vol % SiC is 3.5 times that of pure Mg. As the volume fraction of ceramic nanoparticles increases, the ductility of Mg nanocomposite is retained without further sacrifice.

From the above description and examples, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and/or defined in the appended claims.

What is claimed is:

1. A process for making a bimodal metal matrix nanocomposite, comprising the steps of:

milling a powder mixture comprising micrometer-size metal flakes having an aspect ratio in a range of from about 3:1 to about 10:1 and ceramic nanoparticles for a time sufficient to embed a majority of the ceramic nanoparticles into the metal flakes; and sintering the milled metal flakes with embedded ceramic nanoparticles to produce a nanocomposite having a bimodal microstructure.

2. The process of claim 1, wherein the metal flakes include at least one of magnesium, aluminum, copper, iron, tin, titanium, and nickel.

3. The process of claim 1, wherein the metal flakes comprise at least one of magnesium and magnesium alloy with a flake morphology.

4. The process of claim 1, wherein the metal flakes have a mean particle size of from about 1 to about 250 micrometers.

5. The process of claim 1, wherein the ceramic nanoparticles are formed of at least one of silicon carbide, silicon nitride, aluminum oxide, boron carbide, titanium nitride, titanium oxide, zirconium oxide, yttrium oxide, and cerium oxide.

6. The process of claim 1, wherein the ceramic nanoparticles have a mean particle size of from about 20 nm to about 100 nm.

7. The process of claim 1, wherein the volume fraction of ceramic nanoparticles in the powder mixture is greater than 5% based on the powder mixture volume.

8. The process of claim 1, further comprising adding a grinding aid to the powder mixture prior to or during the milling step.

9. The process of claim 8, wherein the grinding aid comprises a surfactant.

10. The process of claim 8, wherein the grinding aid includes at least one of stearic acid and ethanol.

11. The process of claim 8, wherein 1% to 5% grinding aid is added based on the weight of the powder mixture.

12. The process of claim 11, wherein the grinding aid includes at least one of stearic acid and ethanol.

13. The process of claim 1, wherein the milling step is conducted in an inert atmosphere.

14. The process of claim 1, wherein the milling step is conducted in an argon atmosphere.

15. The process of claim 1, wherein the milling step is conducted with ceramic balls and with a ratio of ball weight to the powder mixture weight in a range of from about 5:1 to about 15:1.

16. The process of claim 15, wherein the powder mixture is milled for a time and milling speed sufficient to embed greater than 95% of the ceramic nanoparticles into the metal flakes.

17. The process of claim 1, wherein the powder mixture is milled in a planetary miller at room temperature.

18. The process of claim 17, wherein the powder mixture is milled for 10 to 20 hours with a milling speed between 150 rpm to 200 rpm.

19. The process of claim 1, further comprising adding surfactant to the milled powder mixture to aid in recovery of the milled metal flakes with embedded ceramic nanoparticles from the mill.

20. The process of claim 1, wherein the milled metal flakes with embedded ceramic nanoparticles are sintered in a vacuum-hot-press furnace.

21. The process of claim 20, wherein the vacuum-hot-press furnace operates at about 90% of the metal flake melting temperature.

22. The process of claim 1, wherein the milled metal flakes with embedded ceramic nanoparticles are sintered to greater than 98% of theoretical density.

23. A process for making a bimodal metal matrix nano-composite, comprising the step of: milling a powder mixture comprising micrometer-size metal flakes having an aspect ratio in a range of from about 3:1 to about 10:1 and ceramic nanoparticles for a time sufficient to embed a majority of the ceramic nanoparticles into the metal flakes.

24. The process of claim 23, wherein the metal flakes comprise at least one of magnesium and magnesium alloy.

* * * * *